US007905706B1

(12) United States Patent
Liang

(10) Patent No.: US 7,905,706 B1
(45) Date of Patent: Mar. 15, 2011

(54) TURBINE BLADE WITH SPAR AND SHELL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 752 days.

(21) Appl. No.: 12/004,948

(22) Filed: Dec. 21, 2007

(51) Int. Cl.
*F01D 5/18* (2006.01)

(52) U.S. Cl. ..... 416/96 R; 415/115; 416/226

(58) Field of Classification Search ..... 415/115; 416/96 R, 97 R, 226
See application file for complete search history.

(56) References Cited

U.S. PATENT DOCUMENTS 4,473,336 A * 9/1984 Coney et al. ..... 416/96 R
4,563,125 A * 1/1986 Boudigues et al. ..... 415/115
5,122,033 A * 6/1992 Paul ..... 416/96 R
* cited by examiner

*Primary Examiner* — Justine Yu
*Assistant Examiner* — Dwayne J White
(74) *Attorney, Agent, or Firm* — John Ryznic

(57) ABSTRACT

A turbine blade of a spar and shell construction with multiple impingement cooling of the shell and cooling air channels formed in the platform to provide cooling for the platform and to provide purge air at the blade fillet to prevent ingestion of hot gas flow. The spar includes a plurality of radial extending cooling air supply channels that function as support members for the shell. The shell includes ribs extending between the walls that define cavities in which the spar cooling air supply channels fit to form the impingement cavities. The shell includes lower ledges that extend outward and abut the platforms extending from the spar to form spent air cooling channels to pass the impingement cooling air through the platform for cooling. A C-shaped clamp member secures the shell to the platform of the spar and form cooling air channels to discharge the spent cooling air into the fillet region of the blade.

11 Claims, 3 Drawing Sheets

View A-A

TURBINE BLADE WITH SPAR AND SHELL COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade of spar and shell construction with cooling of the shell and the platform.

2. Description of the Related Art Including Information Disclosed Under 37 CFR 1.97 and 1.98

A gas turbine engine includes a compressor to compress air, a combustor to burn the compressed air with a fuel and produce a high temperature gas flow, and a turbine to convert the energy from the high temperature gas flow into mechanical energy used to drive the compressor and, in the case of an aero engine to drive a bypass fan, or in the case of an industrial gas turbine (IGT) engine to drive an electric generator.

The efficiency of the engine can be increased by passing a higher temperature gas flow into the turbine. However, the inlet temperature of the turbine is limited to the material properties of the first stage blades and vanes. Higher inlet turbine temperatures can be obtained by a combination of material properties (allowing for higher melting temperatures) and improved airfoil cooling. Since the compressed air used for airfoil cooling is bled off from the compressor, maximizing the amount of cooling while minimizing the amount of cooling air used is a major objective for the engine designer.

To allow for higher temperatures, turbine airfoils can be made from a spar and shell construction. U.S. Pat. No. 7,080,971 B2 issued to Wilson et al on Jul. 25, 2006 and entitled COOLED TURBINE SPAR AND SHELL BLADE CONSTRUCTION discloses a prior art turbine blade with a spar and shell, the entire disclosure incorporated herein by reference. The shell is made from a very high temperature resistant material and with thin walls in order to allow for high heat transfer coefficient from the outside surface to the inside for best cooling. The spar functions as a support for the shell and a channel forming member for cooling air.

BRIEF SUMMARY OF THE INVENTION

It is an object of the present invention to provide for a turbine airfoil with a spar and shell construction with a multiple impingement cooled shell in which the spent cooling air is then sued to cool the platform.

The present invention is a turbine blade with a spar and shell construction in which the shell is cooled by impingement cooling air forced against the backside wall of the shell, and the spent air from the impingement cooling is then passed through cooling passage within the platform to provide cooling to the platform. The spent air from the platform is then discharged out as purge air for the fillet regions.

The shell is a single piece shell that forms the airfoil surface with ribs extending between the walls to provide support. C-shaped clamps are placed over the ledges formed on the lower shell that clamp the shell to the platform of the spar. The C-shaped clamps have cooling passages formed inside that are used for passing the spent cooling air for platform cooling.

BRIEF DESCRIPTION OF THE SEVERAL VIEWS OF THE DRAWINGS

FIG. 4 shows a front view of the clamp construction through line A-A in

FIG. 3.

DETAILED DESCRIPTION OF THE INVENTION

The present invention is a multiple hole impingement cooled spar and shell turbine blade for use in a gas turbine engine. The spar includes a cooling supply passage with impingement holes to provide impingement cooling to the backside wall of the shell. The spent cooling air then flows in a serpentine passage through the blade platform to provide cooling for the platform. The spent cooling air from the platform is then passed out through openings along the fillet to act as purge air and prevent hot gas ingestion and to provide cooling for the fillet region.

Figure 1:
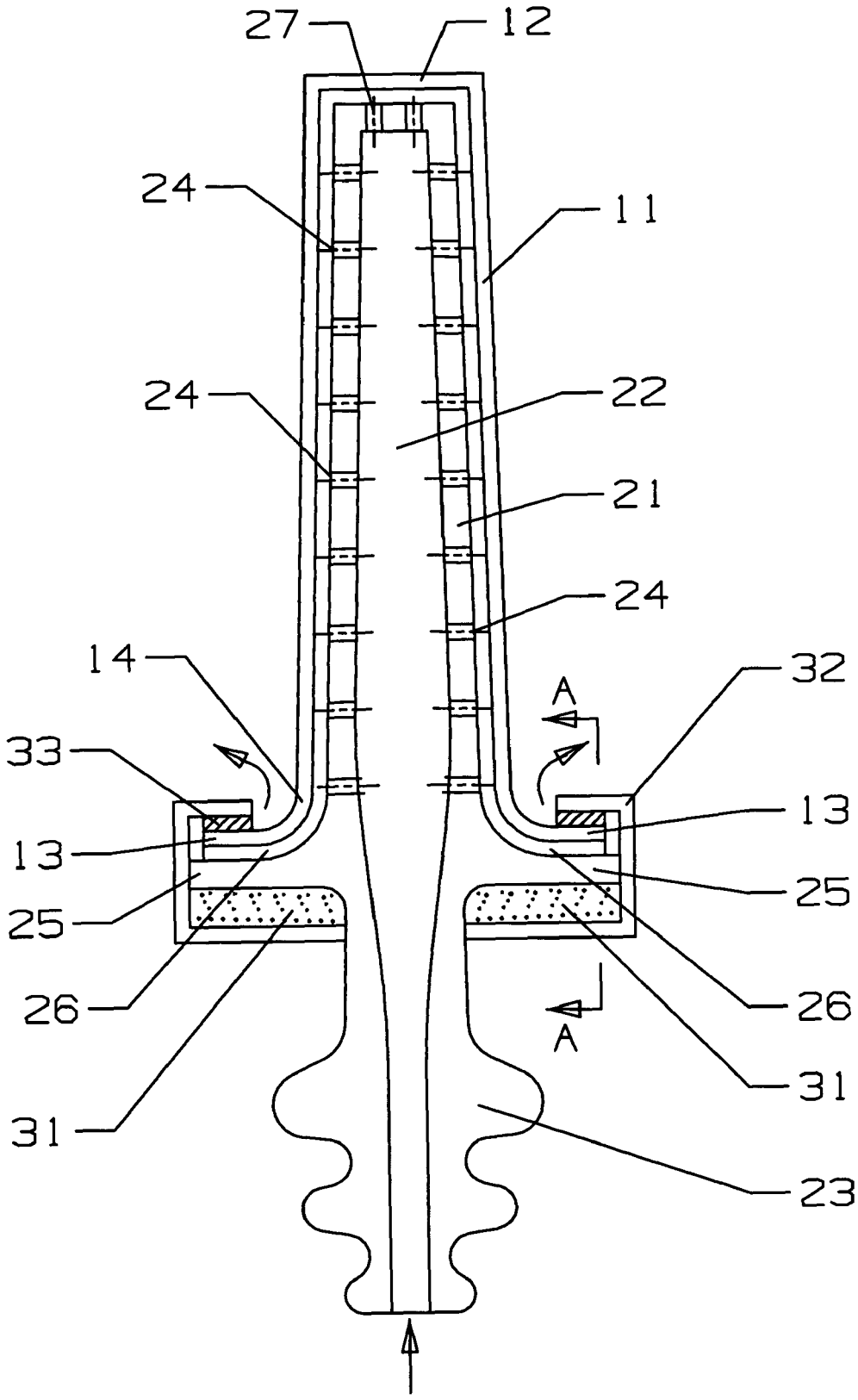
FIG. 1 shows a profile view of the multiple impingement cooled spar and shell blade of the present invention.

FIG. 1 shows a profile view of the turbine blade with the spar and shell construction of the present invention. The shell 11 includes the blade tip 12, the pressure and suction sides, and the leading edge trailing edges formed as a single piece. Also formed on the shell are the lower ledge pieces 13 that extend from the lower end of the shell and spread outward as seen in FIG. 1 and in detail in FIG. 3. The lower edge pieces form a fillet 14 on the airfoil. Micro pin fins or rough surfaces may also be built into the inner surface of the shell 11 to enhance the internal cooling performance.

The spar 21 includes a root portion 23 with a fir tree configuration and an internal cooling air supply channel 22 to channel pressurized cooling air from outside the blade. The spar also includes a plurality of impingement cooling holes 24 spaced around the spar at certain locations to provide impingement cooling for the backside wall of the shell. The spar 21 also includes blade platforms that extend outward from both the pressure side and the suction side. The platforms 25 have cooling spent air return channels 26 formed on the top surface that carry cooling air. A clamp attachment 31 is located underneath the platforms 25, and a clamp having a C-shape 32 is placed over the spar and shell pieces to clamp the platform 25 to the shell lower ledge pieces 13. The spar 21 also includes tip cooling holes on the tip section of the spar 21. Local stand-off ribs are located between the top edge of the C-clamp and the lower surface of the shell ledges and form a cooling air passage from the spent air return channels 26 in the platforms 25 to the fillet region of the airfoil.

Figure 2:
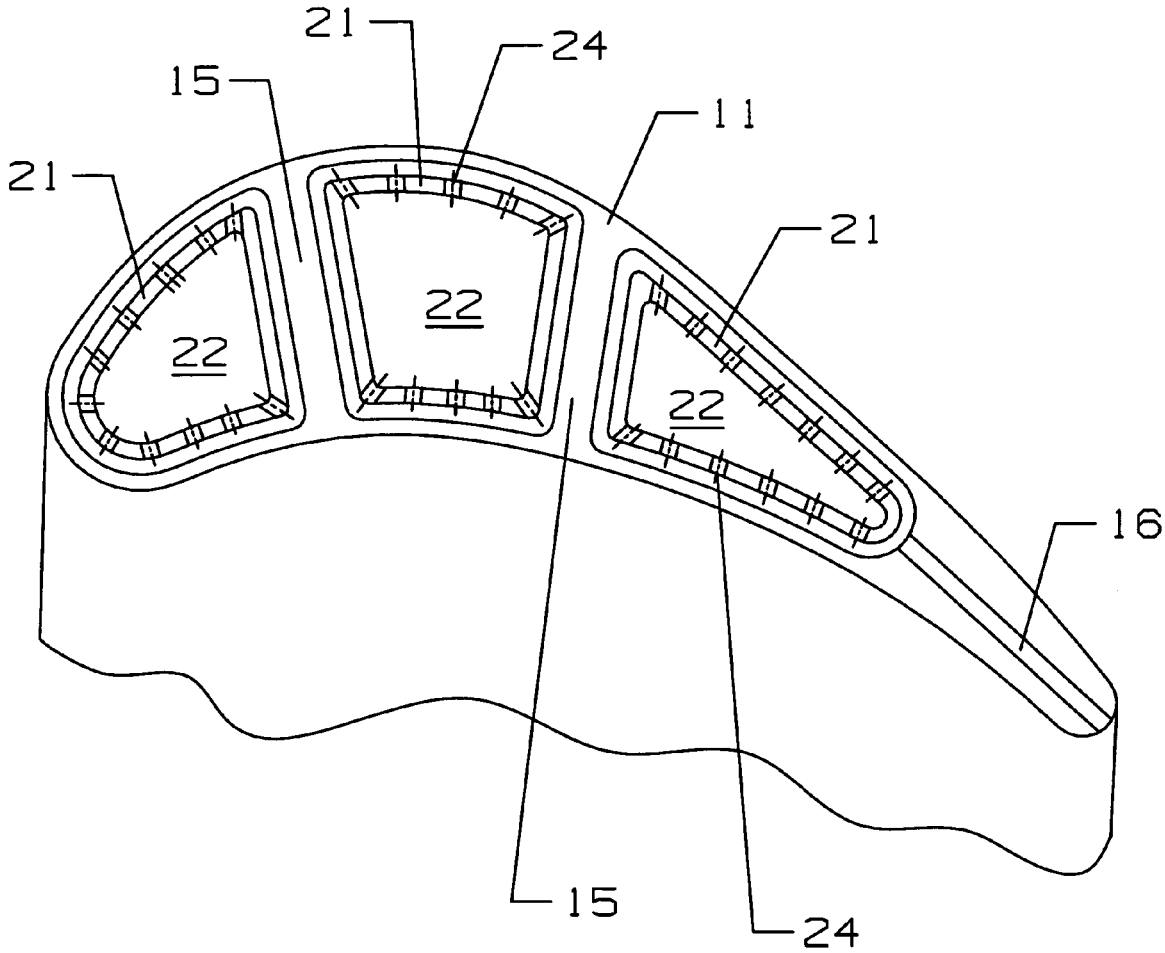
FIG. 2 shows a sectional view of the spar and shell cooled blade of FIG. 1.

FIG. 2 shows a cross sectional view of the spar and shell construction. The shell 21 includes two ribs 15 that extend between the pressure side wall and the suction side wall and divide the inside into three cavities. A row of exit cooling holes 16 are formed along the trailing edge of the shell. The spar 21 includes three radial extending portions that fit into the shell cavities and form the three impingement cavities 22. The impingement holes 24 are spaced around the three radial extending portions of the spar 21 at a location close to the inner wall surfaces of the shell 11 to provide for impingement cooling.

Figure 3:
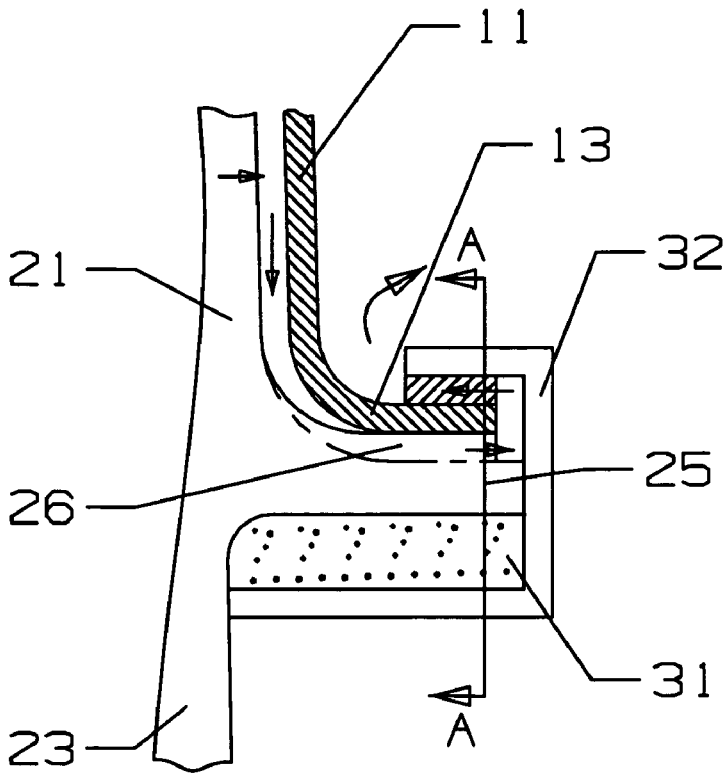
FIG. 3 shows a detailed view of the shell to spar platform clamp construction of the present invention.
Figure 4:
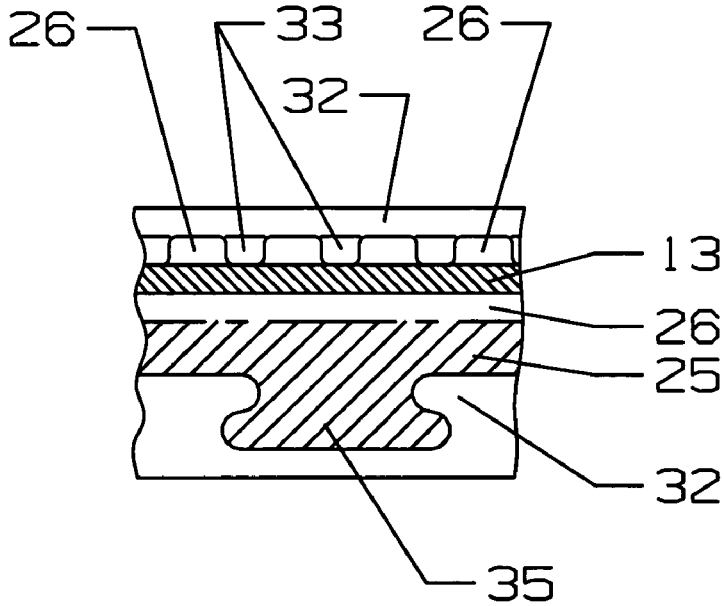

A detailed view of the interface between the spar and shell in the platform is shown in FIG. 3. The spar 21 includes the platform 25 extending outward with the spent air cooling channels 26 located on the top surface. The clamp 32 includes the ribs 33 extending inward to abut against the shell lower edge 13 and form a plurality of parallel flow cooling air channels 26. The platform 25 includes a dovetail 35 on the lower side that engages with a similar shaped dovetail slot formed in the clamp 32 as seen in the detailed view of FIG. 4. The dovetail 35 on the platform and the dovetail slot on the clamp forms the clamp attachment 31 of FIG. 1. The spar and shell can be made of different materials and clamped together at the blade platform junction.

In operation, cooling air is supplied through the airfoil spar cooling supply holes 22 from outside the blade and through the plurality of impingement holes 24 to be impinged onto the inner surface of the shell 11 to provide backside impingement cooling for the airfoil shell 11. Cooling air also flows through the tip holes 27 to provide impingement cooling to the underside surface of the tip 12 of the shell 11. Micro pin fins or rough surfaces may also be built into the inner surface of the shell to enhance the internal cooling performance. The spent cooling air from impingement cooling is then returned to the blade attachment region through the multiple cooling channels 26 which is formed in the airfoil spar structure of the blade platform. The return spent air cooling channels 26 is fixed by the spar edge clamp 32 which is built in around the edge of the blade platform. Cooling air from the airfoil flows through the edge clamp structure (formed by the ribs 33 extending from the clamp 32) to provide cooling and purge air for the blade fillet region prior to being discharged around the blade root fillet section. A portion of the spent cooling air from the impingement holes 24 is channeled through the airfoil trailing edge exit holes 16 formed in the shell 11. The pressurized cooling air supplied to the root 23 (the root can have three separate channels to connect the outside source of cooling air to the three cavities 22 formed by the spar) of the spar flows into the three supply passages 22 and then through the impingement holes located on the sides or the tip to provide for impingement cooling of the inner wall surface of the shell on the airfoil sides and the airfoil tip. The impingement cooling air is then collected in the spent air cooling channel formed between the spar and the shell and channeled to the bottom of the shell and spar where the platform and the lower ledge of the shell abut together. The C-clamp holds the spar and shell together, and also acts to direct the spend cooling air from the channel 26 into the channels formed between the ribs 33 of the C-clamp 32.

I claim the following:

1. An air cooled turbine blade comprising:

a spar having a root, a platform and a cooling air supply channel portion extending from the platform and the root;

a plurality of impingement holes formed in the cooling air supply channel portion to direct impingement cooling air onto an inner surface of a shell wall;

a shell having an airfoil shape with a leading edge and a trailing edge, and a pressure side wall and suction side wall extending between the two edges;

the shell having a lower ledge portion on the pressure side and suction side of the shell, the ledge portions extending outward from the shell;

a spent air return channel formed between the shell lower ledge and the spar platform; and, a clamp to secure the shell to the spar platform.

2. The air cooled turbine blade of claim 1, and further comprising:

the clamp is a C-shaped clamp and forms a plurality of cooling air channels between the clamp and the shell ledges to discharge the cooling air from the spent air return channel into the fillet of the airfoil.

3. The air cooled turbine blade of claim 2, and further comprising:

the spar platform and the C-shaped clamp include a dovetail and a slot to secure the clamp to the platform.

4. The air cooled turbine blade of claim 1, and further comprising:

the spar includes three radial extending cooling air supply channels each with a plurality of impingement cooling holes;

the shell includes two ribs extending across the walls of the shell; and, the shell and ribs and the radial extending cooling air supply channels form three impingement cavities to provide impingement cooling to the backside surface of the shell.

5. The air cooled turbine blade of claim 1, and further comprising:

the shell forms an airfoil tip; and, the cooling supply channel in the spar having a tip section with at least one impingement cooling hole therein such that cooling air from the cooling supply channel provides impingement cooling to the shell tip.

6. The air cooled turbine blade of claim 1, and further comprising:

the clamp engages the shell lower ledge to form a plurality of cooling air channels that discharge the spent cooling air onto the fillet region of the airfoil.

7. The air cooled turbine blade of claim 6, and further comprising:

the clamp forms a cooling air channel between the spent air return channel formed between the platform and the shell and the cooling air channels formed between the shell and the clamp.

8. The air cooled turbine blade of claim 1, and further comprising:

the shell is formed from a single piece of high temperature resistant material.

9. The air cooled turbine blade of claim 1, and further comprising:

the clamp is a C-shaped clamp and includes a dovetail and slot configuration on the clamp to platform interface, and the clamp includes a plurality of cooling channels formed between the interface of the clamp and the shell.

10. The air cooled turbine blade of claim 1, and further comprising:

the shell includes a row of exit cooling holes in the trailing edge to discharge cooling air from the spent air return channel and out from the shell.

11. The air cooled turbine blade of claim 1, and further comprising:

the cooling air supply channel portion of the spar is also a support member for the shell.

* * * * *